US009669279B2

(12) United States Patent
Wang et al.

(10) Patent No.: US 9,669,279 B2
(45) Date of Patent: Jun. 6, 2017

(54) BICYCLE TRAINER WITH A POSITION CHANGEABLE DAMPER UNIT

(71) Applicant: GIANT MANUFACTURING CO., LTD., Taichung (TW)

(72) Inventors: Chih-Kai Wang, Taichung (TW); Wen-Hai Lo, Taichung (TW)

(73) Assignee: Giant Manufacturing Co., Ltd., Taichung (TW)

( * ) Notice: Subject to any disclaimer, the term of this patent is extended or adjusted under 35 U.S.C. 154(b) by 0 days.

(21) Appl. No.: 14/606,550

(22) Filed: Jan. 27, 2015

(65) Prior Publication Data

US 2016/0096100 A1 Apr. 7, 2016

(30) Foreign Application Priority Data

Oct. 1, 2014 (TW) ..... 103217528 U

(51) Int. Cl.
*A63B 69/16* (2006.01)

(52) U.S. Cl.
CPC ..... *A63B 69/16* (2013.01); *A63B 2069/165* (2013.01)

(58) Field of Classification Search
CPC ..... A63B 21/16–2069/168; A63B 2210/50
See application file for complete search history.

(56) References Cited

U.S. PATENT DOCUMENTS

| | | | | |
|---|---|---|---|---|
| 6,780,143 | B2 | 8/2004 | Copeland | |
| 6,945,916 | B2 | 9/2005 | Schroeder | |
| 7,727,124 | B1 * | 6/2010 | Lassanske | A63B 69/16 482/61 |
| 2003/0125167 | A1 * | 7/2003 | Copeland | A63B 69/16 482/61 |

* cited by examiner

*Primary Examiner* — Loan H Thanh
*Assistant Examiner* — Jennifer M Deichl
(74) *Attorney, Agent, or Firm* — Muncy, Geissler, Olds & Lowe, P.C.

(57) ABSTRACT

A bicycle trainer includes a base frame, a damper unit pivotally connected to the base frame and including a rotating wheel set, a swivel frame pivoted to the base frame and biasable between an inclined position where the swivel frame and the damper unit are capable of supporting a bicycle wheel and a collapsed position where the swivel frame is received in the base frame and the rotating wheel set of the damper unit is disposed adjacent to the swivel frame, and a locking device for locking the damper unit to the base frame or allowing the damper unit to be biased relative to the base frame. Thus, the composition of the invention allows the bicycle trainer to be folded up and received in a compact condition to minimize the dimension convenient for carrying with less effort.

5 Claims, 9 Drawing Sheets

BICYCLE TRAINER WITH A POSITION CHANGEABLE DAMPER UNIT

BACKGROUND OF THE INVENTION

1. Field of the Invention

The present invention relates to bicycle training technology and more particularly, to a bicycle trainer, which allows change of the position of the damper unit.

2. Description of the Related Art

In order for bicycle riders to exercise cycling without being affected by weather or the environment, the most common way is to set up the bike on a bicycle trainer, enabling the bike to be pedaled indoors to achieve a training effect similar to riding a bike outdoors.

A conventional bicycle trainer, as illustrated in U.S. Pat. No. 6,945,916 (hereinafter called as Patent 916), mainly comprises a U-shaped frame 2 and two legs 3. The legs 3 can be extended out of the bottom side of the U-shaped frame 2 to allow the bicycle trainer to be positioned on the floor. A rear wheel 9 of a bicycle 8 is held in place between two side bars of the U-shaped frame 2, and kept in contact with an impeller unit 100 that provides a damping resistance to achieve training effects. Further, the U-shaped frame 2 and the legs 3 can be folded up to allow the bicycle trainer to be easily stored.

Further, U.S. Pat. No. 6,780,143 (hereinafter called as Patent 143) discloses another design of bicycle trainer, wherein first and second frame members 18, 20 are pivotally connected to each other so that when the second frame member 20 is positioned on the floor, the first frame member 18 can be moved to an operative extended "up" position with respect to the second frame member 20, allowing a rear wheel 38 of a bicycle to be placed between two arcuate end portions 36 of the first frame member 18. When a user rides the bicycle, the body weight of the user and the weight of the bicycle itself can force the wheel-rotating unit 44 and the rear wheel 38 into engagement with each other for cycling exercises.

The impeller unit 100 or wheel-rotating unit 44 used in the aforesaid Patent 916, 143 or other similar trainer for imparting a damping resistance is fixedly mounted in one lateral side of the trainer. When the U-shaped frame or the first and second frame members are collapsed, the impeller unit 100 or wheel-rotating unit 44 is still kept projecting out of the framework, and thus the trainer storage space must be relatively increased or adjusted for smooth accommodation of the collapsed bicycle trainer.

Further, the impeller unit 100 or wheel-rotating unit 44 uses a heavy wheel or magnetoresistive component to impart a damping resistance. The arrangement of this heavy wheel or magnetoresistive component will shift the center of gravity away from the structural center of the framework of the trainer. When moving the trainer, the applied force cannot be evenly distributed through the framework of the trainer, causing the user unable to carry the trainer stably and safely.

SUMMARY OF THE INVENTION

The present invention has been accomplished under the circumstances in view. It is the main object of the present invention to provide a bicycle trainer, which has a compact structure after folded up, enhancing carrying convenience and safety.

To achieve this and other objects of the present invention, a bicycle trainer of the invention comprises a base frame, a damper unit, a swivel frame, and a locking device. The damper unit comprises a rotating wheel set. Further, the damper unit is pivotally mounted at the base frame, and biasable to change the position of the rotating wheel set relative to the base frame. The swivel frame is pivotally mounted at the base frame, and biasable relative to the base frame between an inclined position where the swivel frame and the damper unit are capable of supporting a bicycle wheel, and a collapsed position where the swivel frame is received in the base frame and the rotating wheel set of the damper unit is disposed adjacent to the swivel frame. The locking device is adapted for locking the damper unit to the base frame, or allowing the damper unit to be biased relative to the base frame. Thus, the bicycle trainer is kept compact when collapsed, minimizing the overall dimension and changing the position or angle of the heavy damper unit. Therefore, the invention allows the rotating wheel set to be shifted into alignment with the center of gravity of the base frame, enabling the user to carry and deliver the collapsed bicycle trainer more conveniently with less effort.

In one embodiment of the present invention, the damper unit comprises a body and a carrier, wherein the body comprises a first positioning portion. The carrier comprises a shaft. The body is mounted at the base frame. The shaft is pivotally connected to the first positioning portion. The carrier is rotatable on the shaft relative to the base frame.

In another embodiment of the present invention, the damper unit comprises a body and a carrier. The carrier is pivotally connected to the body. The locking device comprises a mounting member and a lock pin. The mounting member is mounted at the body. The lock pin is movably mounted in the mounting member. The mounting member has mounted therein a spring member that imparts a pressure to the lock pin to move the lock pin in direction toward the carrier. Thus, the lock pin can be locked to the carrier, or moved away from the carrier.

Other advantages and features of the present invention will be fully understood by reference to the following specification in conjunction with the accompanying drawings, in which like reference signs denote like components of structure.

DETAILED DESCRIPTION OF THE INVENTION

Prior to viewing the following specification in conjunction with the accompanying drawings, it is to be understood that the bicycle trainer of the present invention can be used for bike pedaling training exercises, or simply for supporting a bicycle. Further, the directional terms or similar terms to describe the shape, or the direction such as "front", "rear", "top", "bottom", etc. throughout the specification are simply exemplary directional description languages, not intended for use to limit the scope of the claims.

Figure 1:
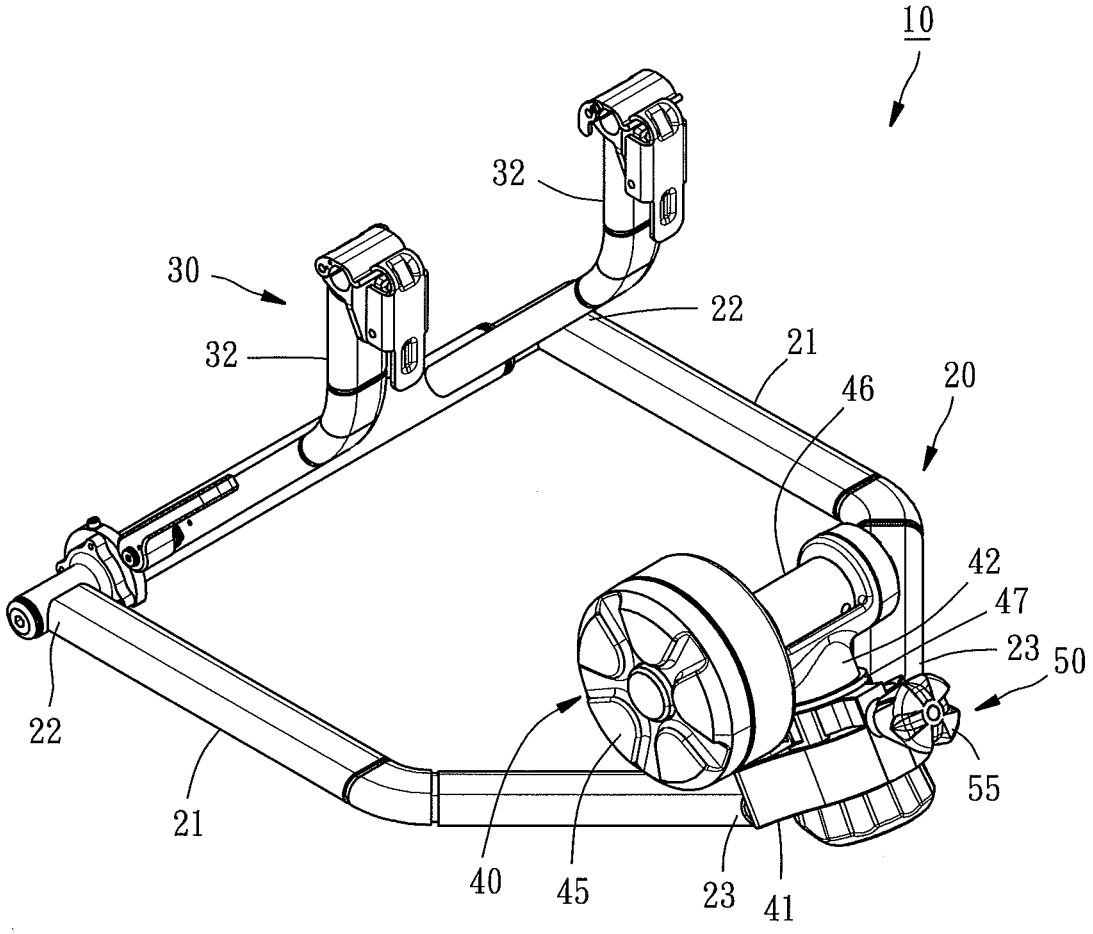
FIG. 1 is an oblique top elevational view of a bicycle trainer in accordance with a first embodiment of the present invention, illustrating a swivel frame in an inclined position relative to a base frame.

Referring to FIG. 1, a bicycle trainer 10 in accordance with a first embodiment of the present invention is shown. The bicycle trainer 10 comprises a base frame 20, a swivel frame 30, a damper unit 40, and a locking device 50. The base frame 20 comprises two parallel extension bars 21. Each extension bar 21 has opposing first end 22 and second end 23. The swivel frame 30 is pivotally connected between the first ends 22 of the two extension bars 21. The damper unit 40 is mounted between the second ends 23 of the two extension bars 21. The swivel frame 30 and the damper unit 40 are respectively located at the base frame 20 at two opposite sides. The swivel frame 30 comprises two support bars 32. The swivel frame 30 can be biased relative to the base frame 20 between an inclined position where the support bars 32 are obliquely lifted from the base frame 20 (see FIG. 1), and a collapsed position where the support bars 32 are received in the base frame 20 between the two extension bars 21 (see FIG. 9).

Figure 2:
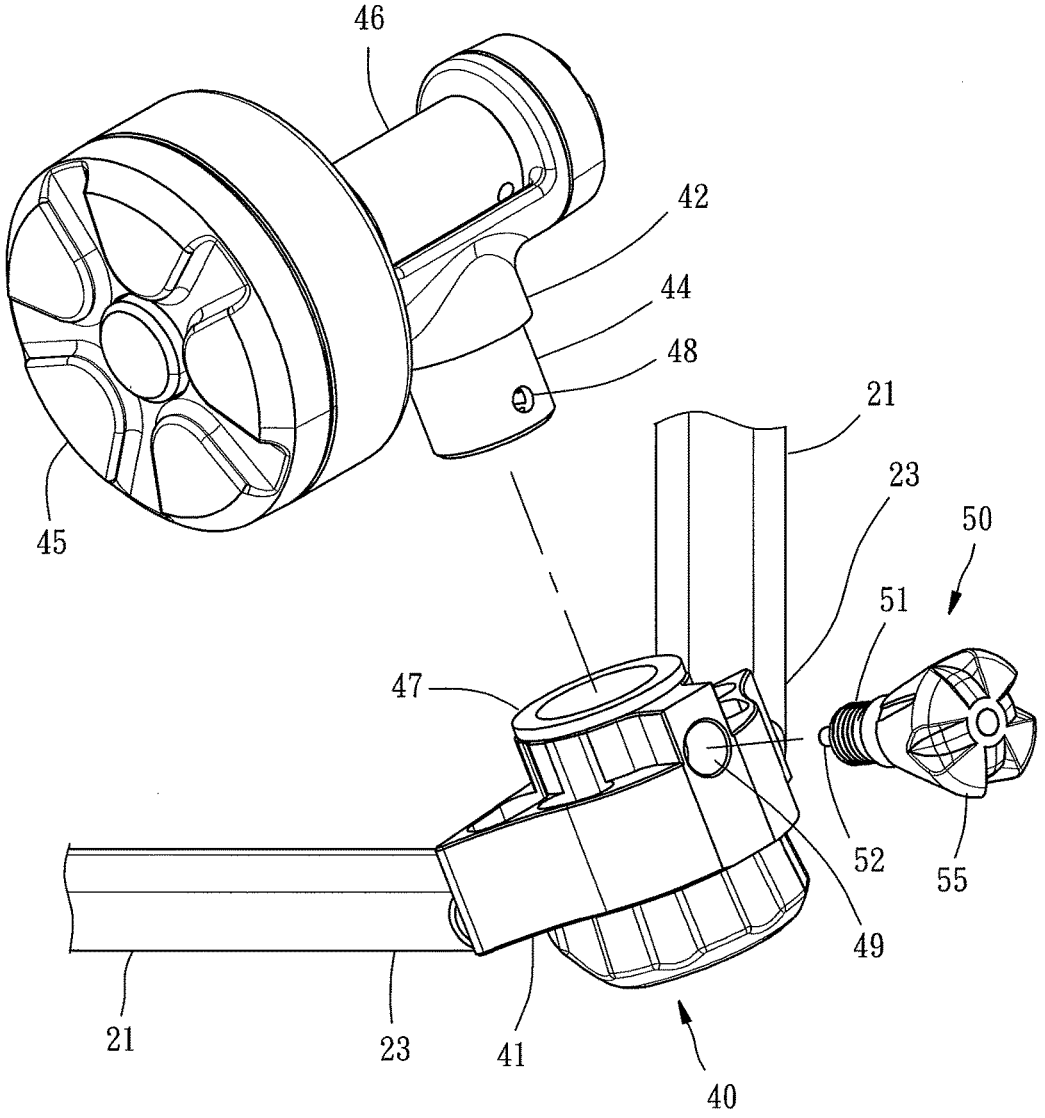
FIG. 2 is an exploded view of the bicycle trainer in accordance with the first embodiment of the present invention.
Figure 3:
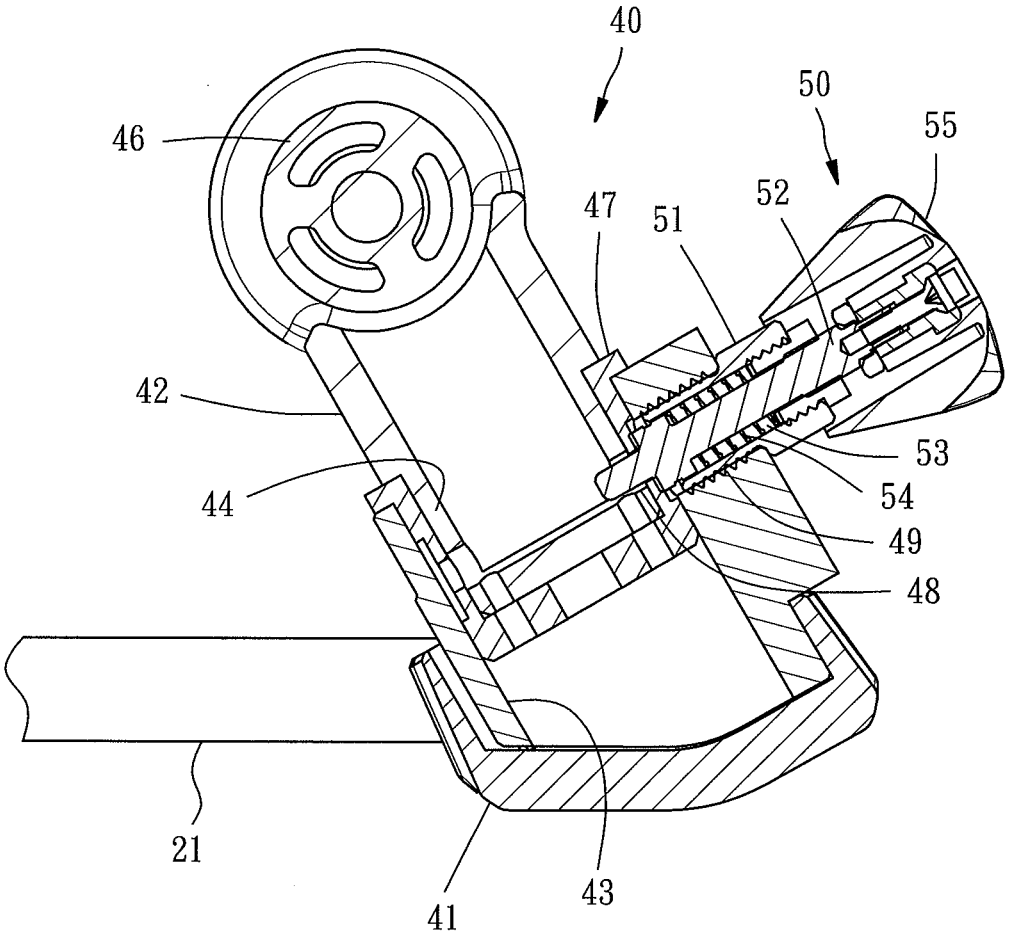
FIGS. 3 and 4 are sectional views taken along line 3-3 of FIG. 1, illustrating a locking position and unlocking position, respectively.

Referring to FIGS. 2 and 3, the damper unit 40 comprises a body 41 and a carrier 42. The body 41 comprises a first positioning portion 43 for holding the carrier 42. In this embodiment, the first positioning portion 43 is a recessed hole inwardly curved from the top wall of the body 41. However, this design recessed hole is simply an exemplar. The carrier 42 comprises a shaft 44 located at the center. Further, the carrier 42 has mounted therein a rotating wheel set 45 and a contact wheel 46. The rotating wheel set 45 is disposed in one lateral side of the carrier 42 and kept away from shaft 44. The contact wheel 46 is disposed to face toward the shaft 44 for rotating the rotating wheel set 45 in the carrier 42. The shaft 44 of the carrier 42 is coupled to the first positioning portion 43 of the body 41 by a socket 47, and can be rotated on the shaft 44 of the carrier 42 relative to the base frame 20. The shaft 44 comprises a plurality of locating portions 48 equally spaced around the shaft 44 at a predetermined distance or angle.

The second ends 23 of the two extension bars 21 of the base frame 20 are respectively connected to two opposite ends of the first positioning portion 43 of the body 41, holding the first positioning portion 43 at the midpoint between the two extension bars 21 in an inclined position toward the swivel frame 30. The body 41 further comprises a second positioning portion 49 adapted for holding the locking device 50. In this embodiment, the second positioning portion 49 is a through hole extending from the periphery of the body 41 to the first positioning portion 43.

Figure 4:
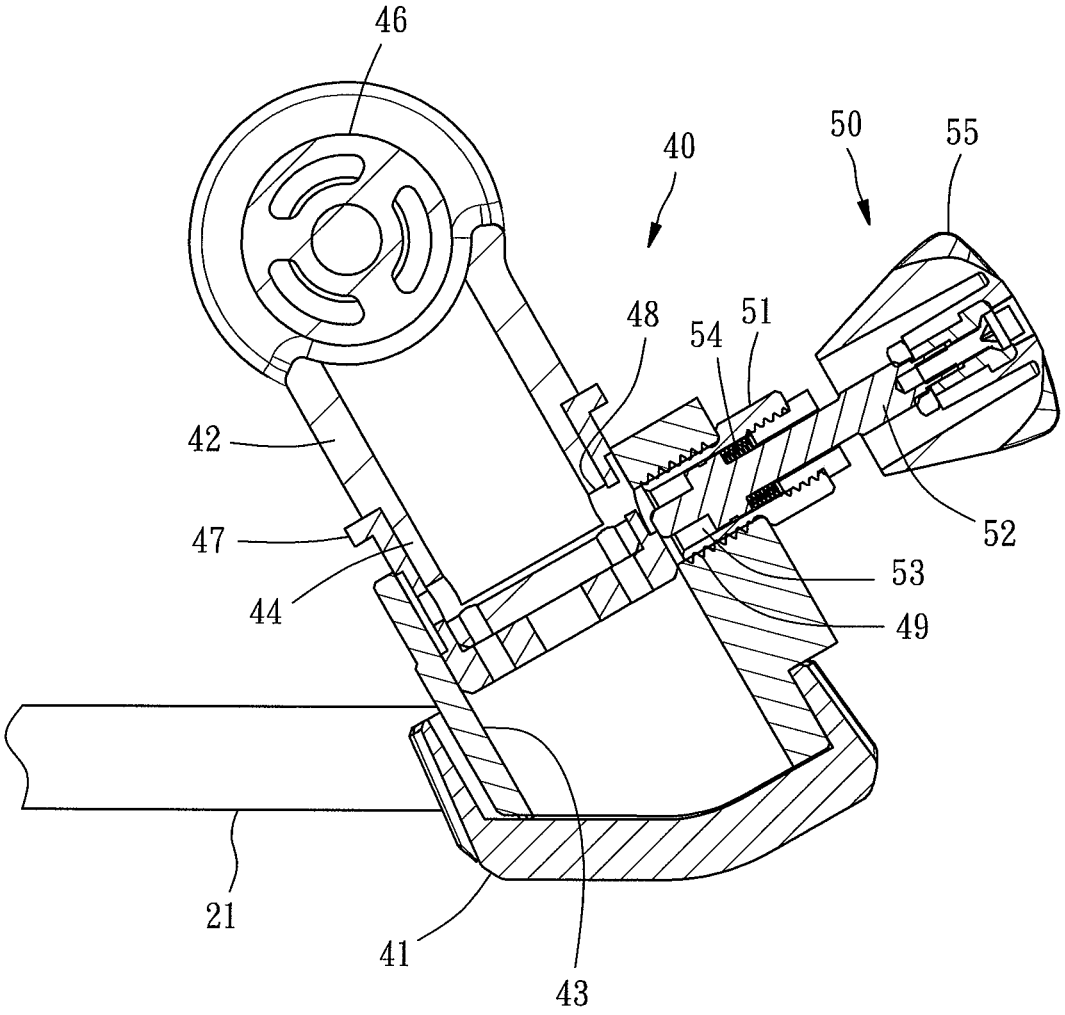

The locking device 50 in this first embodiment is mounted in the damper unit 40. However, this mounting arrangement is not a limitation. Any mounting arrangement of the locking device for enabling the carrier 42 of the damper unit 40 to be selectively locked to or rotatable relative to the base frame 20 should be included in the scope of the present invention. The locking device 50 comprises amounting member 51 and a lock pin 52. The mounting member 51 defines therein a passage hole 53. The lock pin 52 is mounted in the passage hole 53 of the mounting member 51, and movable relative to the mounting member 51 between a locking position (see FIG. 3) and an unlocking position (see FIG. 4). A spring member 54 is mounted in the mounting member 51 around the lock pin 52, and adapted to impart an elastic restoring force to the lock pin 52 to move the lock pin 52 in direction toward the locking position. The mounting member 51 is threaded into the second positioning portion 49 of the body 41. The lock pin 52 has a bottom end thereof face toward the first positioning portion 43 of the body 41 so that the lock pin 52 can be inserted through the socket 47 into one locating portion 48 of the shaft 44 of the carrier 42. Further, the lock pin 52 has a head 55 located at an opposing top end thereof for the holding of the user's hand.

When mounting a bicycle on the bicycle trainer of the above-described first embodiment of the present invention, the user can pull out the lock pin 52 of the locking device 50 to unlock the carrier 42 of the damper unit 40, and then rotate the carrier 42 to the angular position shown in FIG. 1, i.e., to move the rotating wheel set 45 to one lateral side relative to the base frame 20 and to keep the contact wheel 46 facing toward the swivel frame 30. At this time, the user can release the hand from the lock pin 52, enabling the lock pin 52 to be forced by the spring member 54 into the locating portion 48 of the shaft 44 to stop the shaft 44 from rotation relative to the body 41, and thus, the carrier 42 is locked. At this time, the bicycle wheel can be supported between the two support bars 32, enabling the tread of the bicycle wheel to be rotatably abutted at the contact wheel 46 of the damper unit 40.

Figure 5:
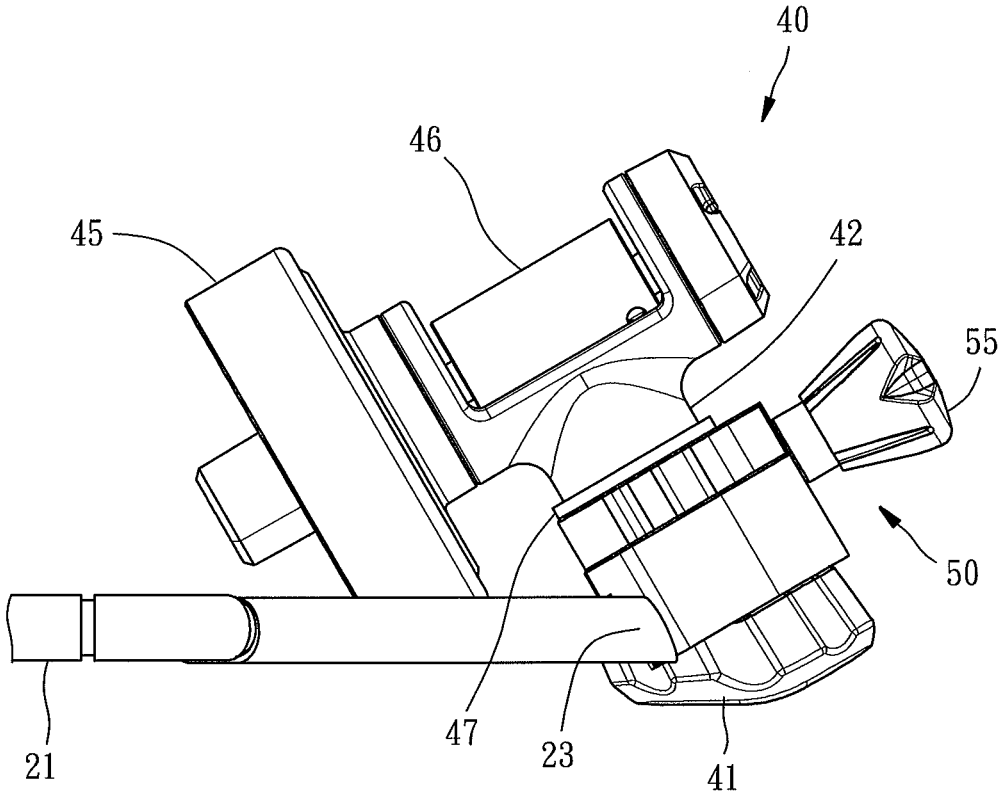
FIG. 5 is a side view of the first embodiment of the present invention, illustrating the carrier biased to the collapsed condition.
Figure 6:
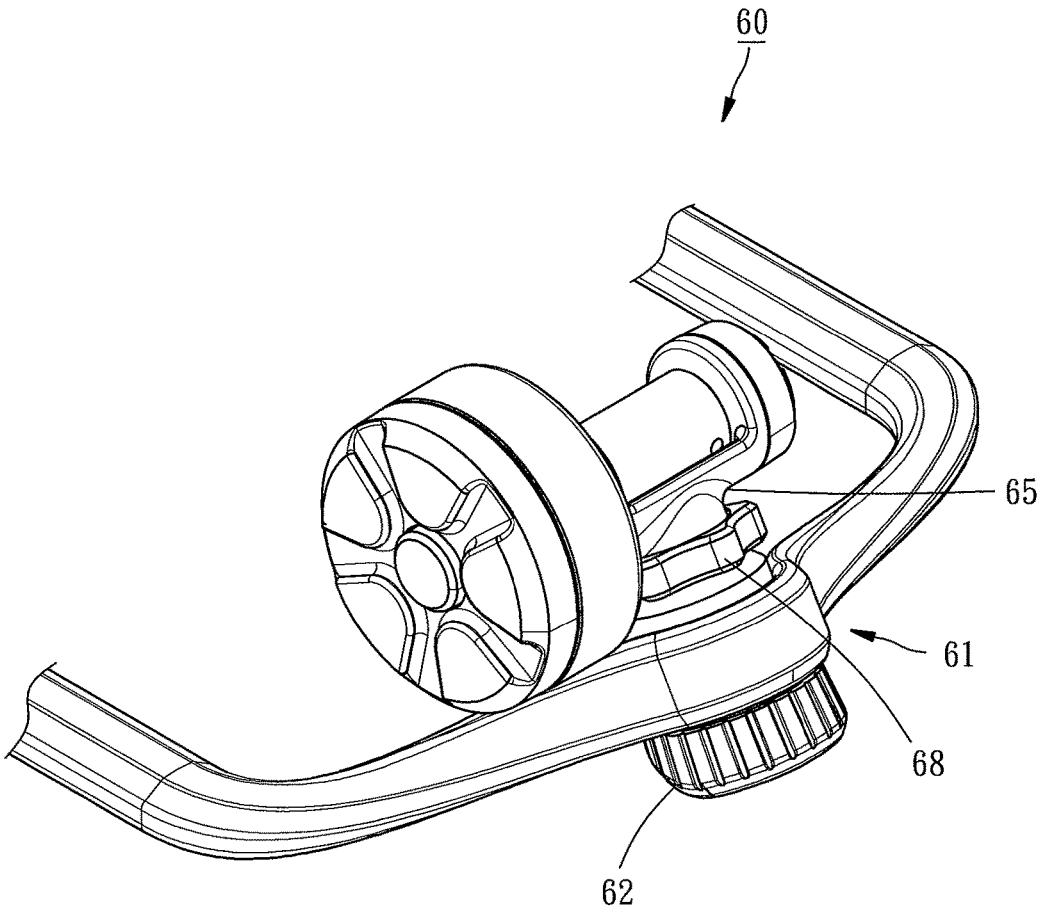
FIG. 6 is an oblique top elevational view of a bicycle trainer in accordance with a second embodiment of the present invention.

When going to collapse the bicycled trainer after removal of the bicycle wheel from the swivel frame 30, the user can pull out the lock pin 52 of the locking device 50 again to disengage the bottom end of the lock pin 52 from the shaft 44, and then rotate the carrier 42 of the damper unit 40 to the angular position shown in FIG. 5, moving the rotating wheel set 45 to the midpoint of the base frame 20 beneath the damper unit 40. Thereafter, the user can release the hand from the lock pin 52, enabling the lock pin 52 to be forced back b y the spring member 54 to lock the carrier 42 again, prohibiting the carrier 42 from rotation relative to the base frame 20. When the swivel frame 30 is biased to the collapsed position and received in the base frame 20, the two support bars 32 are kept at two opposite lateral sides of the damper unit 40 near the rotating wheel set 45.

When the trainer is collapsed as stated above, the swivel frame is received in the base frame, and the rotating wheel set of the damper unit is shifted to the position between the two support bars, keeping the bicycle trainer in a flat condition. Thus, the bicycle trainer is kept compact when collapsed, minimizing the overall dimension and changing the position or angle of the heavy damper unit, and thus, the rotating wheel set can be shifted into alignment with the center of gravity of the base frame, allowing the user to carry and deliver the collapsed bicycle trainer more conveniently with less effort.

Figure 7:
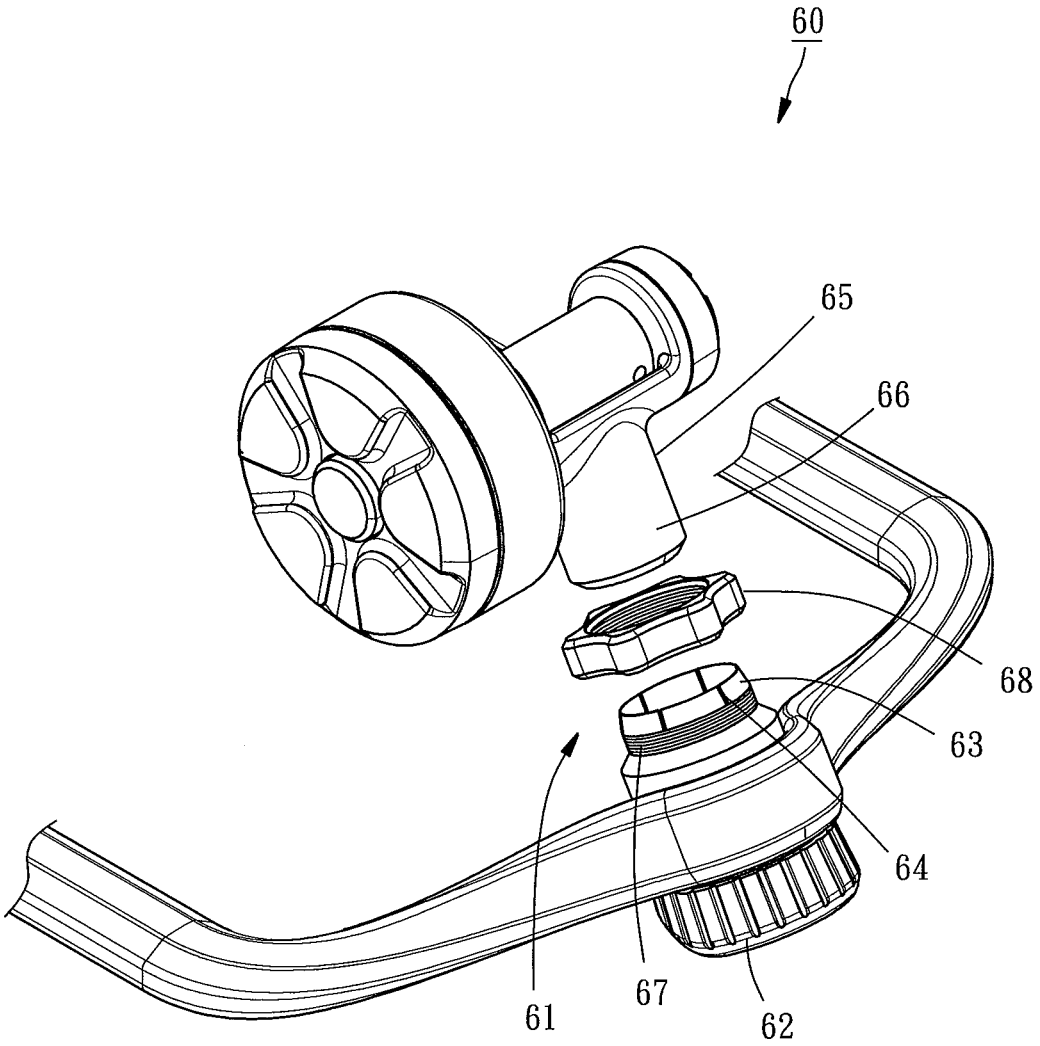
FIG. 7 is an exploded view of the bicycle trainer in accordance with the second embodiment of the present invention.
Figure 8:
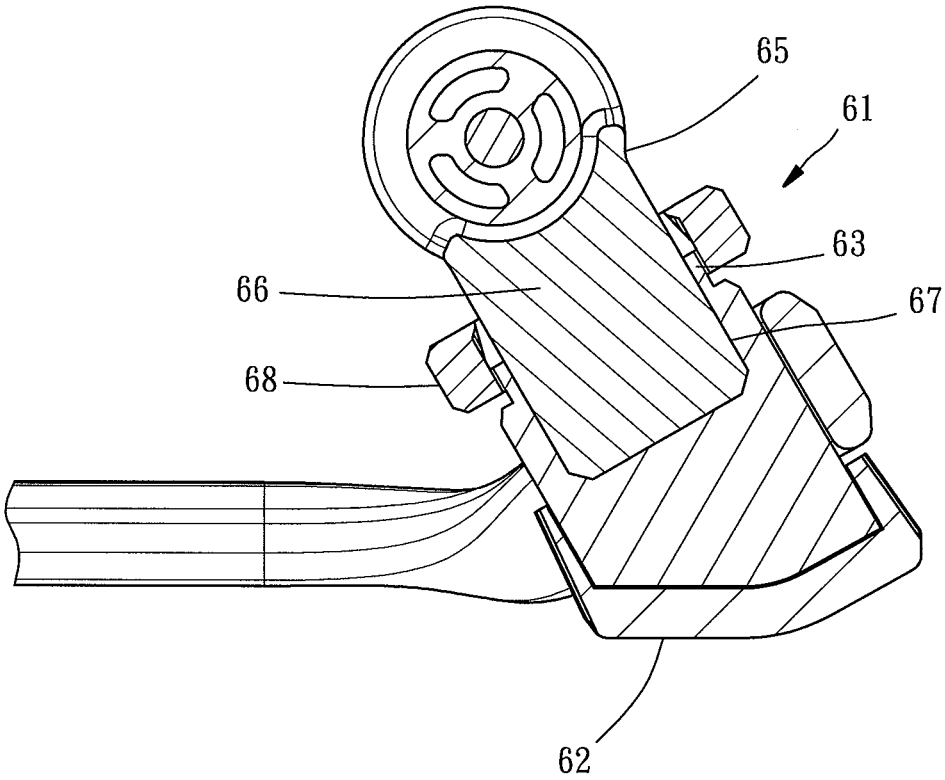
FIG. 8 is a sectional view taken along line 8-8 of FIG. 6.
Figure 9:
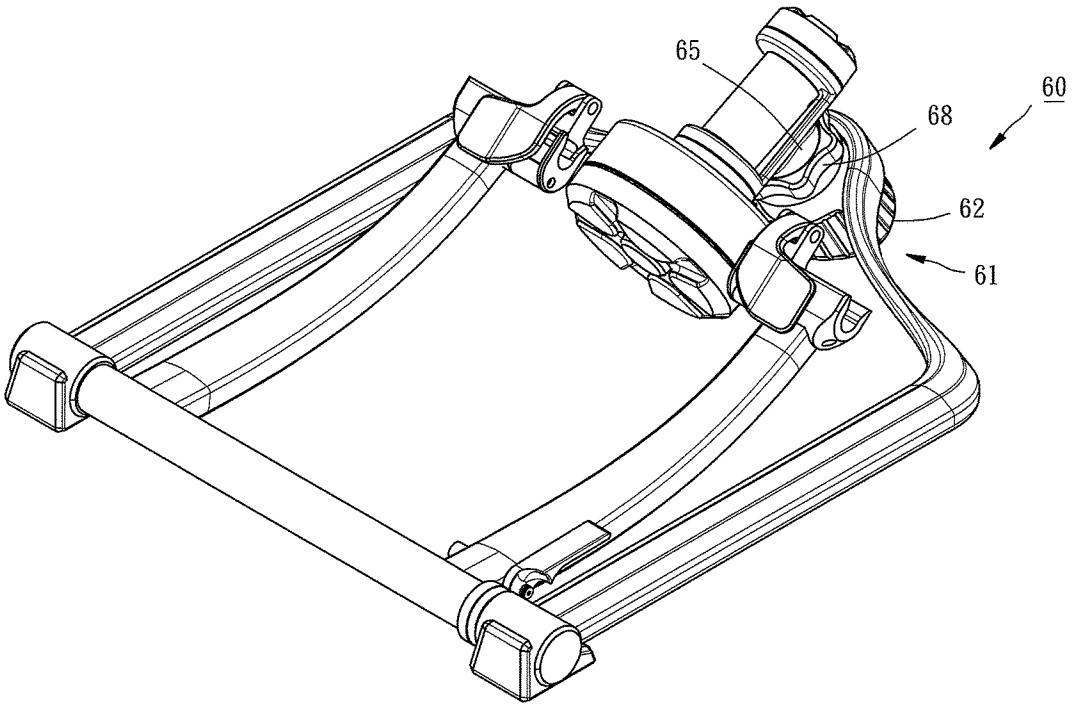
FIG. 9 is another oblique top elevational view of the second embodiment of the present invention, illustrating the bicycle trainer collapsed.

Referring to FIGS. 7-9, a bicycle trainer 60 in accordance with a second embodiment of the present invention is shown. This second embodiment is substantially similar to the aforesaid first embodiment with the exception that the body 62 comprises a holding-down portion 63 extending around the first positioning portion 67. The holding-down portion 63 has a plurality of slits 64 that enhances the elastic deformability of the holding-down portion 63. After the shaft 66 of the carrier 65 is mounted in the first positioning portion 67, the holding-down portion 63 surrounds the shaft 66, a ring member 68 is threaded onto the body 62 in a coaxial manner relative to the first positioning portion 67 to press the inner perimeter thereof onto the holding-down portion 63 and the shaft 66, holding the holding-down portion 63 in between the shaft 66 and the ring member 68. At this time, the user can rotate the ring member 68 along the body 62 to control the contact tightness between the holding-down portion 63 and the shaft 66. If the ring member 68 is rotated to the position where the holding-down portion 63 is elastically deformed and compressed, the shaft 66 is constrained by the ring member 68 and the holding-down portion 63 and prohibited from rotation to lock the damper unit. If the ring member 68 is rotated to the position where the ring member 68 is kept away from the holding-down portion 63, the shaft 66 is released from the constraint of the holding-down portion 63 for free rotation, and the damper unit can be biased to the desired position or angle, and thus, this second embodiment achieves the same effects and object of the aforesaid first embodiment.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A bicycle trainer, comprising:

a base frame;

a damper unit comprising a rotating wheel set, said damper unit being pivotally mounted at said base frame for allowing change of the position of said rotating wheel set relative to said base frame;

a swivel frame pivotally connected to said base frame and biasable relative to said base frame between an inclined position where said swivel frame and said damper unit are capable of supporting a bicycle wheel, and a collapsed position where said swivel frame is received in said base frame and said rotating wheel set of said damper unit is kept near said swivel frame; and a locking device operable to selectively lock said damper unit to said base frame or to unlock said damper unit from said base frame for biasing relative to said base frame, wherein said damper unit comprises a carrier, said carrier comprising a shaft located at the center of said carrier, said shaft being rotatably coupled to said base frame, wherein said carrier comprises said rotating wheel set and a contact wheel, said rotating wheel set being disposed at one lateral side of said carrier away from shaft, said contact wheel being disposed to face toward said shaft, said carrier being rotatable on said shaft relative to said base frame to carry said rotating wheel set to a midpoint of said base frame at a lower side of said damper unit, and wherein said rotating wheel set of said damper unit is rotatable to a position in alignment with the center of gravity of said base frame when said damper unit is unlocked from said base frame.

2. The bicycle trainer as claimed in claim 1, wherein said damper unit comprises a body, said body comprises a first positioning portion and a second positioning portion, said second positioning portion being kept in communication with said first positioning portion, said carrier being pivotally connected to said first positioning portion; said locking device comprises a movable lock pin, said locking device being mounted in said second positioning portion for enabling said lock pin to be locked to or movable away from said carrier.

3. The bicycle trainer as claimed in claim 2, wherein said shaft comprises at least one locating portion; said lock pin is detachably engageable into one said locating portion of said shaft.

4. The bicycle trainer as claimed in claim 1, wherein said damper unit comprises a body, said carrier being pivotally connected to said body; said locking device comprises a mounting member and a lock pin, said mounting member being mounted at said body, said lock pin being movably mounted in said mounting member, said mounting member having a spring member mounted therein, said spring member being adapted to impart a pressure to said lock pin in direction toward said carrier for enabling said lock pin to be locked to or moved away from said carrier.

5. The bicycle trainer as claimed in claim 1, wherein said damper unit comprises a body, said body comprising a holding-down portion, said carrier being pivotally connected to said body; said locking device comprises a ring member, said ring member being movably mounted on said body and sleeved onto said holding-down portion and said carrier, said holding-down portion being disposed between said carrier and said ring member, said ring member being movable to hold down said holding-down portion on said carrier or for enabling said holding-down portion to be separated from said carrier.

* * * * *